US009267760B2

(12) United States Patent
Slinkard

(10) Patent No.: US 9,267,760 B2
(45) Date of Patent: Feb. 23, 2016

(54) CONCEALABLE HOLSTER

(71) Applicant: Bushnell, Inc., Overland Park, KS (US)

(72) Inventor: Jason Slinkard, Overalnd Park, KS (US)

(73) Assignee: Bushnell, Inc., Overland Park, KS (US)

( * ) Notice: Subject to any disclaimer, the term of this patent is extended or adjusted under 35 U.S.C. 154(b) by 269 days.

(21) Appl. No.: 14/084,328

(22) Filed: Nov. 19, 2013

(65) Prior Publication Data

US 2015/0115005 A1 Apr. 30, 2015

Related U.S. Application Data

(60) Provisional application No. 61/896,433, filed on Oct. 28, 2013.

(51) Int. Cl.
*F41C 33/02* (2006.01)
*F41C 33/04* (2006.01)

(52) U.S. Cl.
CPC ..... *F41C 33/0227* (2013.01); *F41C 33/043* (2013.01); *F41C 33/048* (2013.01)

(58) Field of Classification Search
CPC .. F41C 33/0227; F41C 33/041; F41C 33/043; F41C 33/048
USPC ..... 224/192, 193, 243, 244, 911, 912
See application file for complete search history.

(56) References Cited

U.S. PATENT DOCUMENTS

| | | | | | |
|---|---|---|---|---|---|
| 4,408,706 | A * | 10/1983 | Hurley | B26B 29/025 | 224/192 |
| 4,828,154 | A * | 5/1989 | Clifton, Jr. | A45F 5/14 | 224/192 |
| 5,236,113 | A * | 8/1993 | Wisser | F41C 33/0227 | 224/193 |
| 6,092,703 | A * | 7/2000 | Johnson | F41C 33/0209 | 224/198 |
| 6,189,756 | B1 * | 2/2001 | Ward | F41C 33/0227 | 224/240 |
| 7,314,152 | B1 * | 1/2008 | Garrett | F41C 33/0236 | 224/192 |
| 8,973,799 | B2 * | 3/2015 | Ruiz, III | F41C 33/048 | 224/192 |
| 2006/0219743 | A1 * | 10/2006 | Gallagher | A45F 5/02 | 224/192 |

* cited by examiner

*Primary Examiner* — J. Gregory Pickett
*Assistant Examiner* — Corey Skurdal
(74) *Attorney, Agent, or Firm* — Hovey Williams LLP

(57) ABSTRACT

The present invention provides a holster for holding an object in a left handed, a right handed, a straight draw, and/or a cross draw arrangement in a first orientation or a second orientation. The holster is worn between the torso of the wearer and the wearer's waistband for carrying or concealing the weapon. The holster is vertically and angularly adjustable for providing a comfortable fit and easy access to the weapon by the wearer. The holster mounts onto the wearer's waistband while allowing the wearer to tuck his shirt between the holster and the waistband.

20 Claims, 5 Drawing Sheets

CONCEALABLE HOLSTER

RELATED APPLICATIONS

This non-provisional patent application claims priority benefit with regard to all common subject matter of earlier-filed U.S. provisional patent application also titled CONCEALABLE HOLSTER, filed Oct. 28, 2013, and assigned application No. 61/896,433. The earlier-filed application is hereby incorporated by reference in its entirety into the present application.

BACKGROUND OF THE INVENTION

Embodiments of the present invention relate to holsters. More particularly, embodiments of the present invention relate to holsters that are worn between a wearer's body and the wearer's clothing, sometimes referred to as "inside-the-waistband (IWB) tuckable holsters".

IWB tuckable holsters are often worn by law enforcers and civilians for concealing and carrying handheld weapons and other objects. However, existing holsters are limited in the ways they can be attached to the wearer's clothing. This restricts where the wearer can conceal a weapon in relation to his torso. The angle and the height at which the weapon is holstered is also restricted, which prevents the wearer from concealing the weapon in an optimal position and orientation according to his stature, arm reach, etc.

SUMMARY

Embodiments of the present invention solve the above-mentioned problems and provide a distinct advance in the art of holsters.

One embodiment of the invention is a holster for holding an object in a left handed, a right handed, a straight draw, and/or a cross draw arrangement in a first orientation or a second orientation. The holster broadly includes a band, a first clip, a second clip, a first connector, a second connector, and a strap. The band has a cavity for inserting at least a portion of a weapon therein and a first and a second set of holes spaced from each other for attaching the clips to the band. The first clip has a third set of holes and the second clip has a fourth set of holes that are selectively alignable with the holes of the band. The first and second connectors connect the clips to the band through the aligned holes. When connected to the band, the clips each form a space with the band for tucking a shirt therein. By connecting the first and the second clips to the band via different holes, the holster may be vertically and angularly adjusted. The strap secures the weapon in the cavity and is selectively shiftable to an unsecured configuration for removing the weapon from the cavity. The clips and the strap may be reversed to face an opposite direction in relation to the band for shifting the holster between the first and second orientations.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
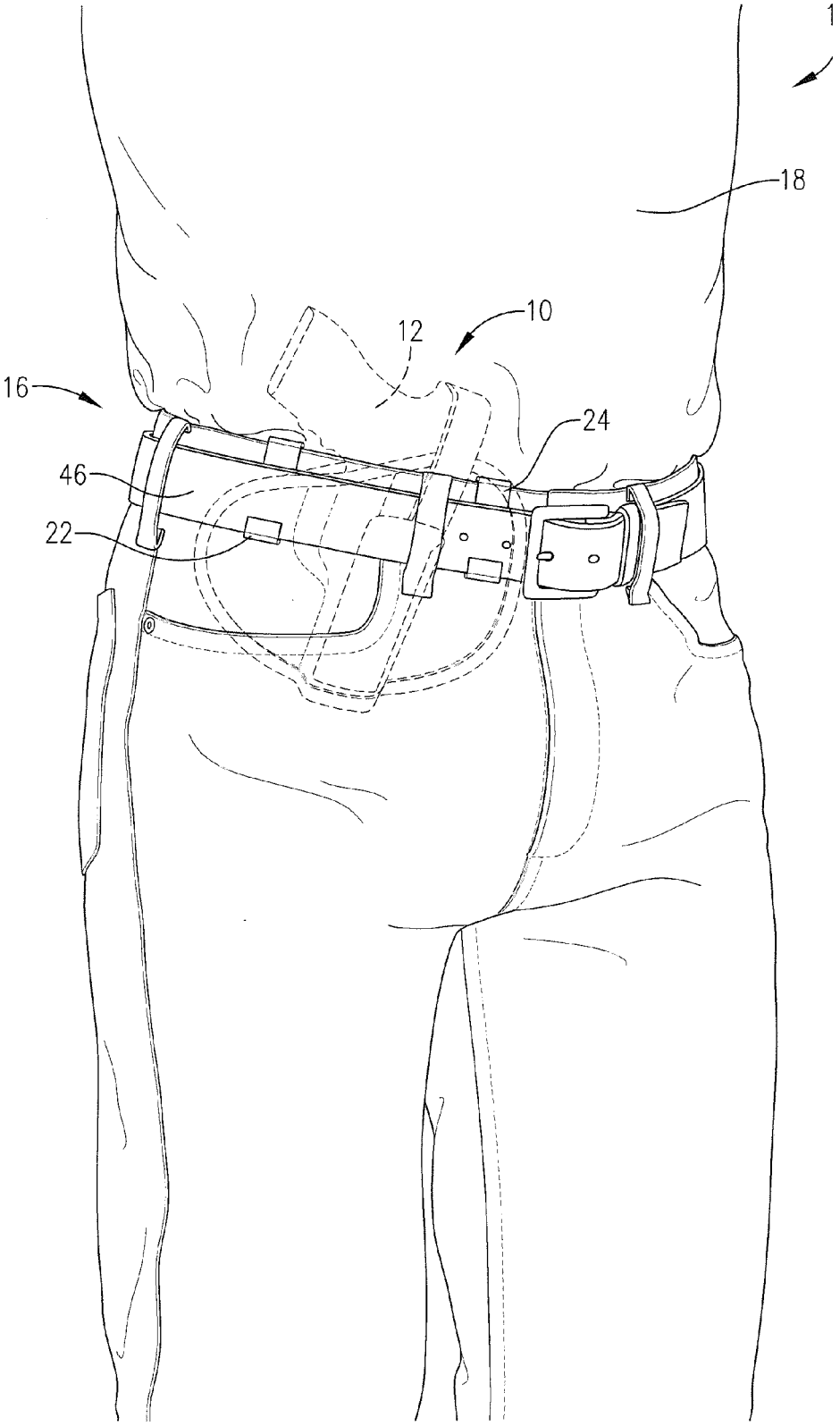
FIG. 1 is a side elevation view of a wearer donning an IWB holster holding a weapon, the holster and the weapon being concealed (represented by dashed lines) behind the wearer's shirt and pants in accordance with an embodiment of the invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning to the figures, and particularly FIGS. 1-5, a holster 10 for holding a weapon 12 such as a gun in a left handed, a right handed, a straight draw, and/or a cross draw arrangement in a first orientation or a second orientation is shown. It will be understood that the holster 10 may also hold a knife, a taser, a baton, a chemical sprayer, a flashlight, a communication device, or any other weapon or object. The holster 10 is worn between the torso of the wearer 14 and the wearer's waistband 16 for concealing the weapon 12 therein, as shown in FIG. 1. The holster 10 may be worn in a first orientation or a second orientation mirroring the first orientation in almost any position around the wearer's waist, such as on the left hip, the right hip, near the appendix, and behind the back, and can be worn with the weapon 12 oriented for a left handed draw or a right handed draw. The holster 10 can also be positioned for a standard draw or a cross draw wherein the wearer 14 reaches across his body to draw the weapon 12. The holster 10 is vertically and angularly adjustable for providing a comfortable fit and easy access to the weapon 12 by the wearer 14 while preventing other people from easily removing the weapon 12, as described below. The holster 10 mounts onto the wearer's waistband 16 while allowing the wearer to tuck his shirt 18 between the holster 10 and the waistband 16.

The holster 10 broadly includes a band 20, a first clip 22, a second clip 24, a first connector 26, a second connector 28, and a strap 30, each of which are described in more detail below.

Figure 2:
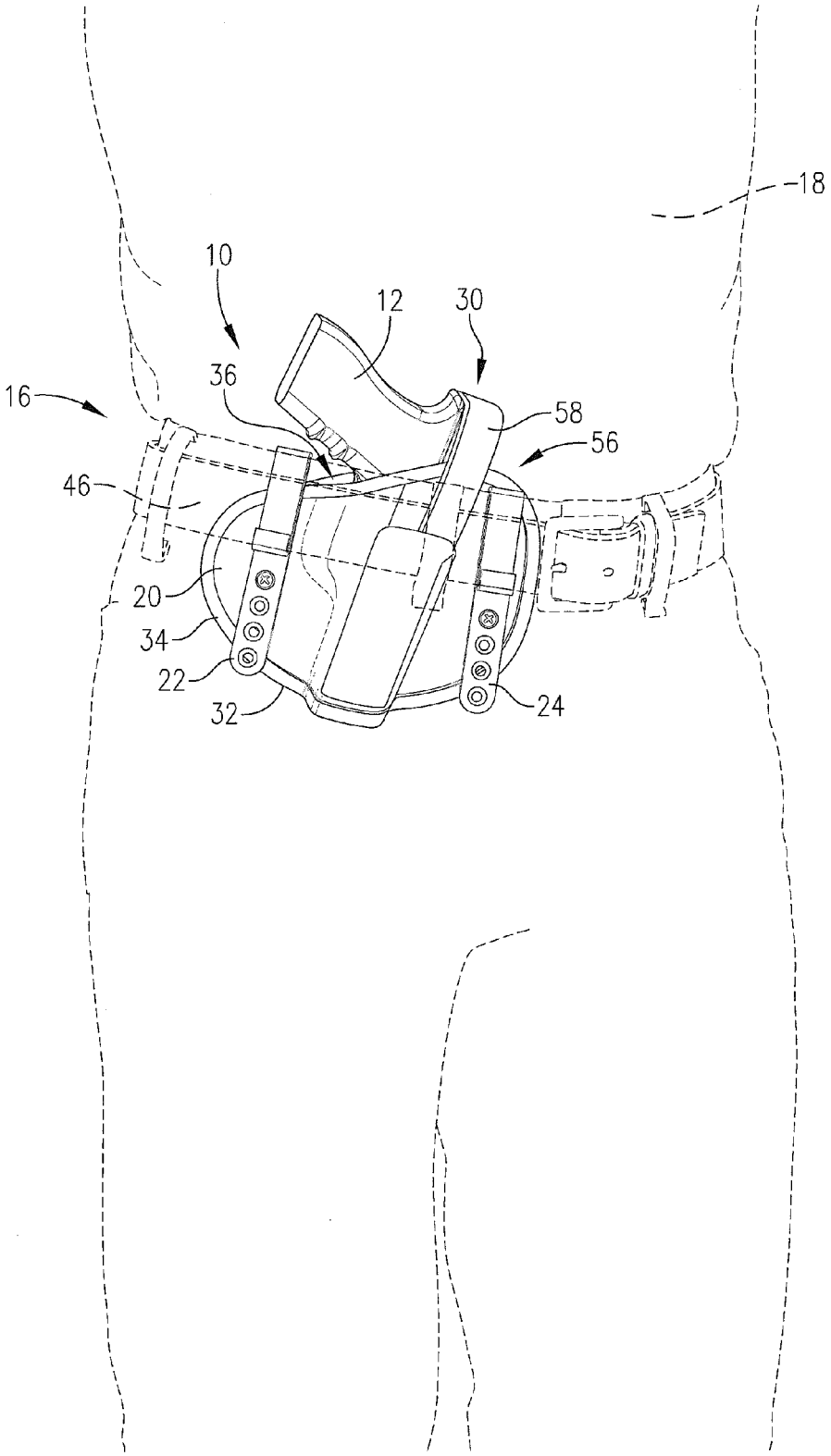
FIG. 2 is a side elevation view of the holster in FIG. 1 showing the clips in relation to the band when the holster is donned and adjusted according to the wearer's preferences.

The band 20 is provided for conforming to the torso of the wearer 14 and giving structure to the holster 10 and is inserted between the torso of the wearer 14 and the waistband 16, as shown in FIG. 2. The band 20 may be formed of a flexible fabric or other material such as cotton, wool, polyester, plastic, rubber, nylon, or combination of materials. The band 20 may include multiple layers of material for forming a cavity (described below) or for increasing the resilience thereof. The band 20 is configured to be bent, curved, or folded to fit to the contours of the wearer's torso. The band 20 may also be inverted (e.g., bent backwards) so that the weapon 12 can be carried on an opposite side of the torso or so that the weapon 12 can be oriented in an opposite direction. The band 20 may have an outer edge 32 shaped to have straight portions and corners, such as a rectangle, curves such as a circle, a plurality of convex and concave curved sections, curved sections having varying degrees of curvature, such as an oval, or a combination of these features. The band 20 may be reinforced with wire, plastic, cardboard, or other resilient material for providing rigidity. For example, a wire member 34 may be sewn into the band 20 around the outer edge 32 for giving the band 20 an overall shape.

Figure 3:
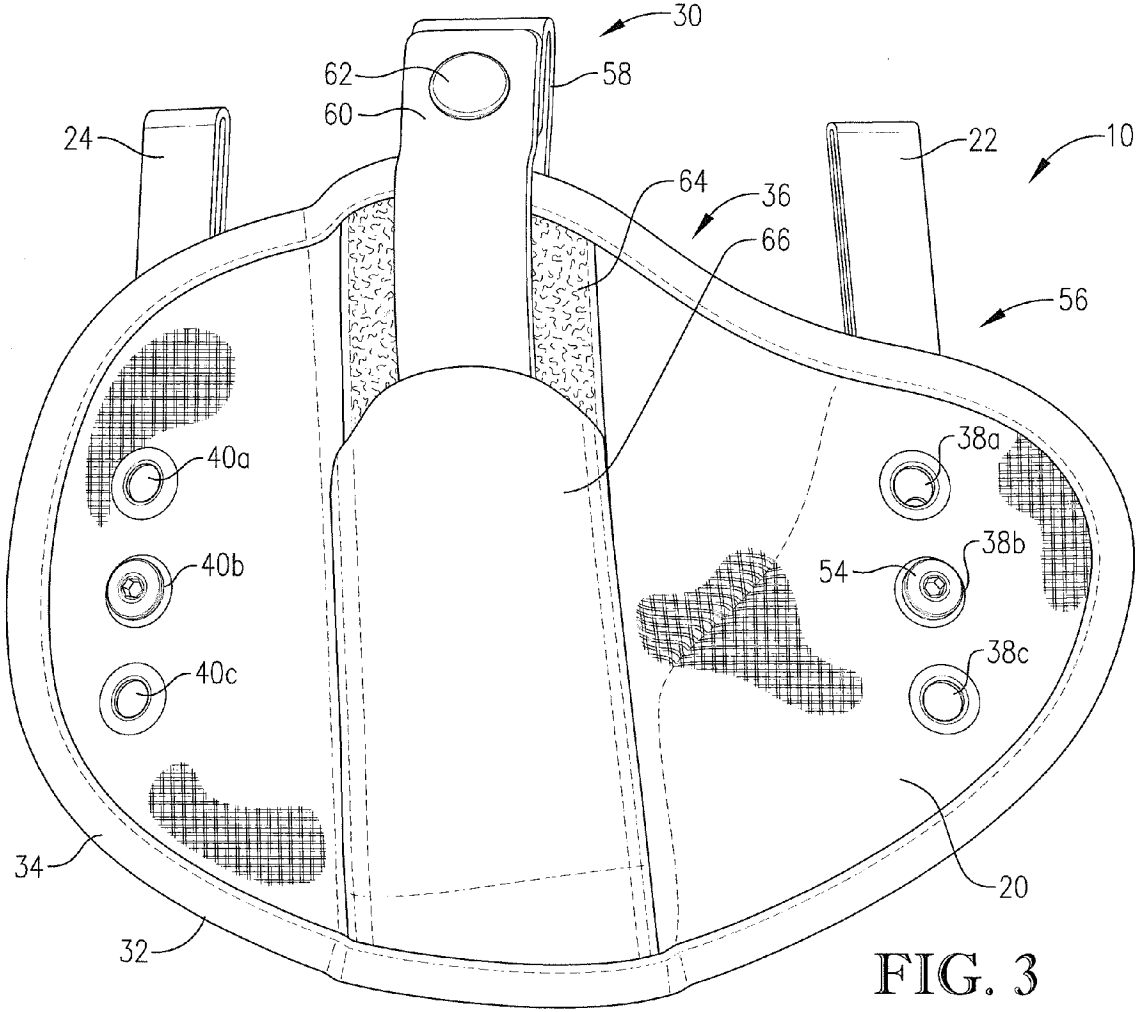
FIG. 3 is a side elevation of a first side of the holster of FIG. 1.
Figure 4:
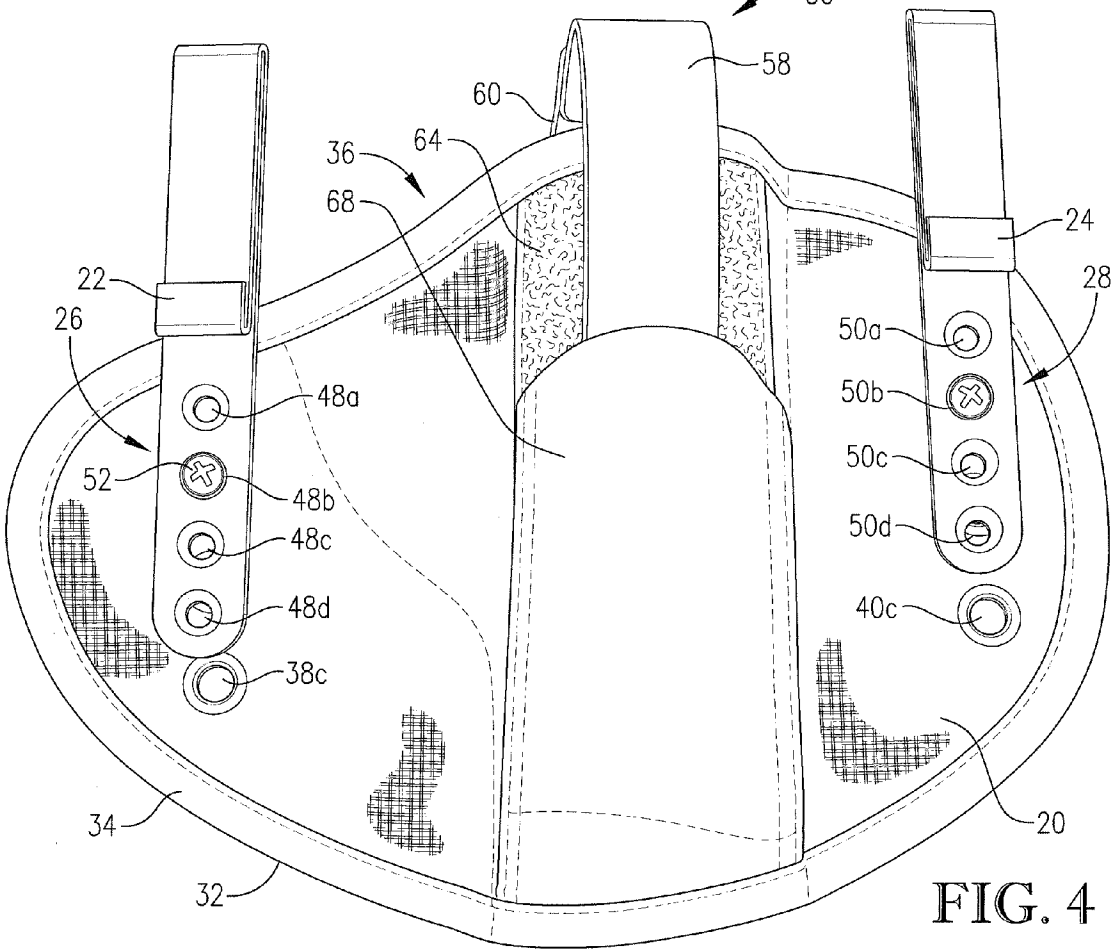
FIG. 4 is a side elevation of a second side of the holster of FIG. 1 opposite the first side.
Figure 6:
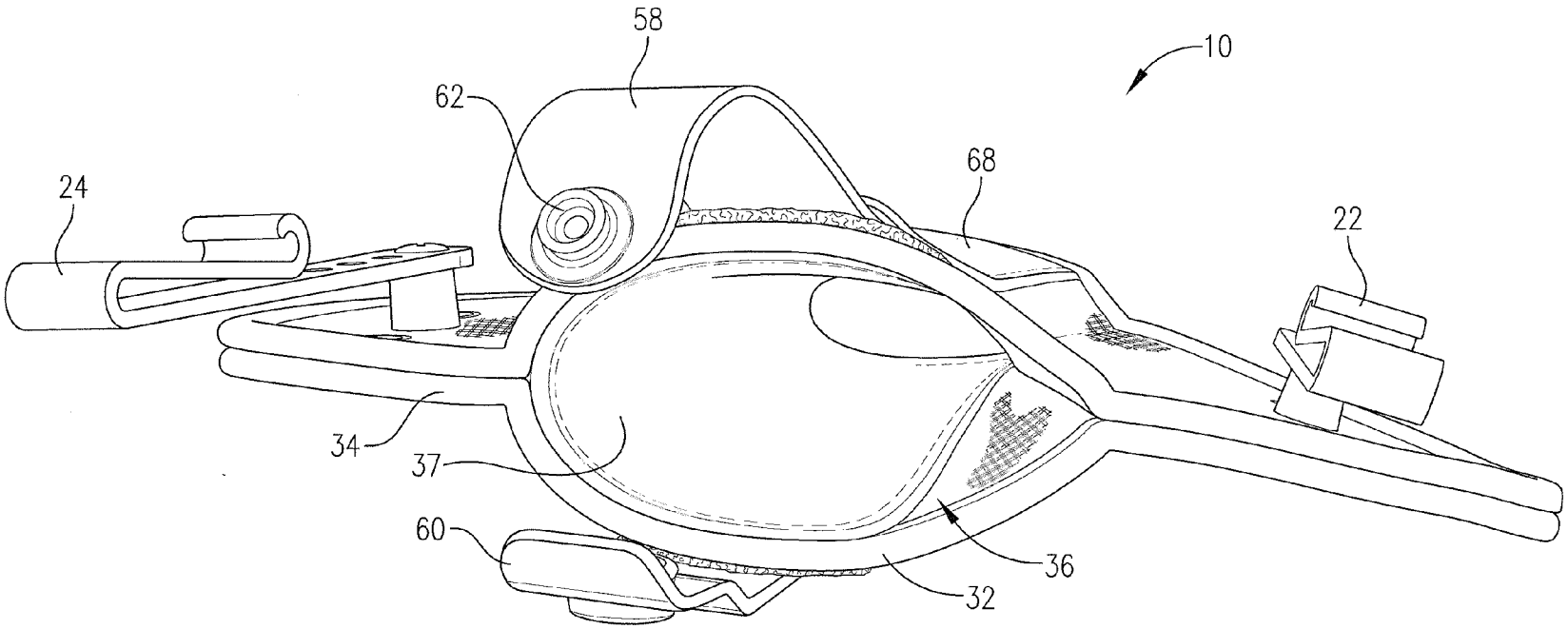
FIG. 6 is a top view of the holster of FIG. 1 showing a cavity for holding the weapon therein and a liner disposed in the cavity for retaining a shape of the cavity.

The band 20 has a cavity 36 for inserting at least a portion of the weapon 12 therein, as best shown in FIGS. 4 and 6. The cavity 36 has an open top, closed sides, and a partially closed bottom. The cavity 36 may have an internal shape for conforming to the weapon 12. For example, the cavity 36 may be shaped to receive the barrel and the trigger guard of the weapon 12 therein. The cavity 36 may be formed between two or more layers of material attached together. The layers may be symmetric, with the cavity being disposed equally therebetween, so that the holster 10 bends equally regardless of the holster's orientation. The cavity 36 may be reinforced with a plastic liner 37 (FIG. 6) or other resilient material disposed therein or embedded in the band 20 and secured by stitching, glue, wire, or compressive forces, etc. for maintaining a desired shape. The cavity 36 may also terminate at a lower end of the band 20 or may extend through the band 20 thus forming a lower hole for draining moisture or dirt. The band 20 also includes a first and a second set of holes 38*a-c*, 40*a-c* spaced from each other, as best shown in FIG. 3. Each set of holes 38*a-c*, 40*a-c* may include as few as 2 holes or as many as 6 holes and may form a straight line or other formation. The holes 38*a-c*, 40*a-c* may be reinforced with gromets or additional material.

Figure 5:
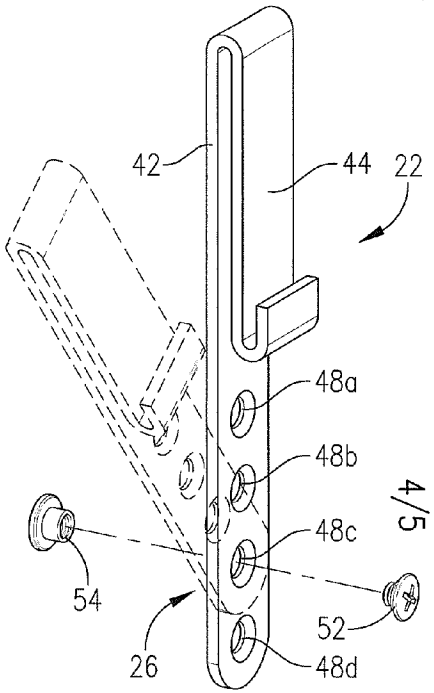
FIG. 5 is an exploded view of a clip of the holster of FIG. 1.

The first and second clips 22, 24 are provided for attaching the holster 10 to the wearer's waistband 16 and are detachable from the band 20, as shown in FIGS. 4 and 5. The clips 22, 24 may both be connected to the band 20 on either side thereof, thus facing an opposite direction in relation to the band 20, for reversing the orientation of the weapon 12 (i.e., shifting between the first orientation and the second orientation). The clips 22, 24 are formed of a resilient material such as plastic, rubber, or metal. Each clip 22, 24 has a first section 42 extending upwards for inserting behind the waistband 16 and a second section 44 extending downwards from a top of the first section 42 for sliding over an outside of the waistband 16 and optionally behind a belt 46 of the wearer 14 (FIGS. 1 and 2). The second section 44 may curve upwards at a lower end for catching or clipping onto a lower portion of the belt 46. This prevents the holster 10 from "riding up" as the wearer 14 moves. The clips 22, 24 have a third and a fourth set of holes 48*a-d*, 50*a-d*, respectively on the first section 42. Each set of holes 48*a-d*, 50*a-d* may include as few as 2 holes or as many as 6 holes, may be countersunk or counterbore for urging the connectors 26, 28 (described below) therein, and may form a straight line or other formation. The connector 26 is provided for selectively connecting the first clip 22 to the band 20 through one hole of the first set of holes 38*a-c* and one hole of the third set of holes 48*a-d*. The connector 28 is provided for connecting the second clip 24 to the band 20 through one hole of the second set of holes 40*a-c* and one hole of the fourth set of holes 50*a-d*. Each connector 26, 28 may have a first section 52 and a second section 54 of complementary means for fastening together such as magnets, a male and a female screw and receiver, a buckle, a snap, etc. Each section 52, 54 may have ends that are wider than the holes 38*a-c*, 40*a-c*, 48*a-d*, 50*a-d* for preventing the clips 22, 24 from separating from the band 20 when the sections 52, 54 are connected. By selectively inserting the connectors 26, 28 through different holes, the holster 10 may be vertically and angularly adjusted. For example, if the wearer 14 wishes for the band 20 to be mounted high in relation to his waistband 16, the connectors 26, 28 are inserted through the highest holes 48*a*, 50*a* on the clips and the lowest holes 38*c*, 40*c* on the band 20. The clips 22, 24 each form a space 56 with the band 20 for tucking the shirt 18 therein (FIG. 2). The space 56 extends behind and below the waistband 16 when the clips 22, 24 are positioned over the waistband 16 so that the shirt 18 may be tucked in inconspicuously and so that the band 20 and the weapon 12 are concealed.

Turning again to FIGS. 3 and 4, the strap 30 is provided for securing the weapon 12 in the cavity 36. The strap 30 is formed of a bendable semi-resilient material such as plastic or rubber. The strap 30 extends vertically and wraps around a back end of the weapon 12 to prevent the weapon 12 from being unintentionally removed or from being removed by another person. The strap 30 may include a first and a second portion 58, 60 connectable at top ends thereof by a detaching mechanism 62, such as a button, a snap, a latch, a buckle, or Velcro® for selectively shifting the strap 30 to an unsecured configuration for easily and quickly removing the weapon 12. The strap 30 is connected at lower ends of the portions 58, 60 to the band 20 by a connecting means 64 such as Velcro®, snaps, string, clips, or other fasteners. The strap 30 can be adjusted vertically by connecting the portions 58, 60 to the band 20 at various heights for accommodating the weapon 12 or objects of various sizes. The strap 30 may be disconnected from the band 20 by urging a thin blade-like tool known in the art between the strap 30 and the band 20. The strap 30 can be reversed to face an opposite direction in relation to the band 20 such that the first and the second portions 58, 60 are disposed in or on opposite sides of the band 20 for shifting the holster 10 between the first and the second orientations. Optionally a first and a second external pocket 66, 68 formed of elastic material are attached on opposite sides of the band 20 to prevent the strap 30 and the connecting means 64 from catching on clothing etc.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A holster for holding an object in a left handed, a right handed, a straight draw, and/or a cross draw arrangement in a first orientation or a second orientation, the holster comprising:

a band for inserting between a wearer's torso and clothing, the band having a cavity for inserting at least a portion of the object therein, a first plurality of holes, and a second plurality of holes spaced from the first plurality of holes;

a substantially vertically-extending strap for securing the object in the cavity in the first orientation or the second orientation, the strap being selectively adjustable to secure various sized objects in the cavity and being selectively shiftable to an unsecured configuration for removing the object from the cavity;

a first clip having a third plurality of holes for selectively aligning with one of the first plurality of holes in the first orientation or the second orientation;

a second clip having a fourth plurality of holes for selectively aligning with one of the second plurality of holes in the first orientation or the second orientation, the first and the second clip being operable to connect the holster to the wearer's clothing when the band is between the wearer's torso and clothing, the first clip and the second clip each forming a space with the band for tucking a shirt therein;

a first connector for connecting the first clip to the band through one of the first plurality of holes and one of the third plurality of holes; and a second connector for connecting the second clip to the band through one of the second plurality of holes and one of the fourth plurality of holes, wherein the holster is vertically and angularly adjustable by connecting the first and second clips to the band via different ones of the first and the third pluralities of holes and the second and the fourth pluralities of holes, respectively, and is shiftable between the first orientation and the second orientation by reversing the substantially vertically-extending strap and the first clip and the second clip to face an opposite direction in relation to the band.

2. The holster of paragraph 1, further comprising a mechanism for quickly shifting the strap to the unsecured configuration.

3. The holster of paragraph 2, further comprising a liner formed of resilient material for retaining a shape of the cavity.

4. The holster of paragraph 1, wherein the band is formed of a flexible fabric.

5. The holster of paragraph 4, wherein the first and the second clips are formed of a resilient material.

6. The holster of paragraph 4, wherein the band is reinforced with a resilient member along an outer edge of the band.

7. The holster of paragraph 6, wherein the band includes an outer edge forming a continuous curve.

8. The holster of paragraph 1, wherein the strap is configured to wrap around a back end of the object for securing the object in the cavity.

9. The holster of paragraph 8, wherein the strap is formed of a resilient material.

10. The holster of paragraph 1, wherein the band and the strap include complementary hook and loop connecting strips for adjustably connecting the strap to the band.

11. The holster of paragraph 10, wherein the band further includes at least one pocket for inserting a lower end of the strap therein.

12. The holster of paragraph 11, wherein the pocket is at least partially formed of an elastic material for conforming to the strap.

13. The holster of paragraph 12, wherein the cavity is formed symmetrically along a plane of the band.

14. The holster of paragraph 1, wherein the first and second connectors each include a male screw fastener and a female backing operable to receive the male screw fastener therein, the male screw fastener and the female backing each having a head wider than the holes, for securing one of the clips to the band.

15. The holster of paragraph 1, wherein the first plurality of holes are aligned in a first straight line, the second plurality of holes are aligned in a second straight line, the third plurality of holes are aligned in a third straight line, and the fourth plurality of holes are aligned in a fourth straight line.

16. The holster of paragraph 1, wherein the first plurality of holes and the second plurality of holes each comprise three holes, and the third plurality of holes and the fourth plurality of holes each comprise five holes.

17. The holster of paragraph 1, wherein each clip includes a first section and a second section extending downward from a top of the first section for clipping over the user's clothing, the second section having an end curving upwards for clipping under a user's belt.

18. A holster for holding an object in a left handed, a right handed, a straight draw, and/or a cross draw arrangement in a first orientation or a second orientation, the holster comprising:

a band having a first plurality of holes, a second plurality of holes spaced from the first plurality of holes and forming a straight line parallel to the straight line of the first plurality of holes, and a cavity including a bottom, a left, and a right side defined by stitching for inserting at least a portion of the object therein;

a substantially vertically-extending strap for securing the object in the cavity in the first orientation or the second orientation, the strap being selectively adjustable to secure various sized objects in the cavity and being selectively shiftable to an unsecured configuration for removing the object from the cavity;

at least one pair of complementary hook and loop connecting strips for adjustably connecting the strap to the band;

a first clip having a third plurality of holes for selectively aligning with one of the first plurality of holes in the first orientation or the second orientation;

a second clip having a fourth plurality of holes for selectively aligning with one of the second plurality of holes in the first orientation or the second orientation, the first and second clips being operable to connect the holster to a wearer's clothing when the band is between the wearer's torso and clothing, the first clip and the second clip each forming a space with the band for tucking a shirt therein;

a first connector for connecting the first clip to the band through one of the first plurality of holes and one of the third plurality of holes; and a second connector for connecting the second clip to the band through one of the second plurality of holes and one of the fourth plurality of holes, wherein the holster is vertically and angularly adjustable by connecting the first and second clips to the band via different ones of the first and the third pluralities of holes and the second and the fourth pluralities of holes, respectively, and is shiftable between the first orientation and the second orientation by reversing the substantially vertically-extending strap and the first clip and the second clip to face an opposite direction in relation to the band.

19. The holster of paragraph 18, wherein the third and fourth plurality of holes are countersunk into the first and second clips, respectively.

20. A holster for holding an object in a left handed, a right handed, a straight draw, and/or a cross draw arrangement in a first orientation or a second orientation, the holster comprising:

a band having a first plurality of holes, a second plurality of holes spaced from the first plurality of holes, and a cavity for inserting at least a portion of the object therein, the cavity being formed symmetrically along a plane of the band;

a substantially vertically-extending strap for securing the object in the cavity in the first orientation or the second orientation, the strap being selectively adjustable to secure various sized objects in the cavity and being selectively shiftable to an unsecured configuration for removing the object from the cavity;

a mechanism for quickly shifting the strap to the unsecured configuration;

a first clip having a third plurality of holes for selectively aligning with one of the first plurality of holes in the first orientation or the second orientation;

a second clip having a fourth plurality of holes for selectively aligning with one of the second plurality of holes in the first orientation or the second orientation, the first and the second clips being operable to connect the holster to the user's clothing when the band is between the user's torso and clothing, wherein each clip includes a first section and a second section extending downward from a top of the first section for clipping over the user's clothing, the second section having an end curving upwards for clipping under a user's belt, the first clip and the second clip forming a space with the band for tucking a shirt therein;

a first connector for connecting the first clip to the band through one of the first plurality of holes and one of the third plurality of holes; and a second connector for connecting the second clip to the band through one of the second plurality of holes and one of the fourth plurality of holes, wherein the holster is vertically and angularly adjustable by connecting the first and second clips to the band via different ones of the first and the third pluralities of holes and the second and the fourth pluralities of holes, respectively, and is shiftable between the first orientation and the second orientation by reversing the substantially vertically-extending strap and the first clip and the second clip to face an opposite direction in relation to the band.

* * * * *